US008523718B1

(12) United States Patent
Kuhn

(10) Patent No.: US 8,523,718 B1
(45) Date of Patent: Sep. 3, 2013

(54) ARROW VANE AIRFOIL

(75) Inventor: Todd A. Kuhn, North East, MD (US)

(73) Assignee: Todd Kuhn, Gulfport, MS (US)

( * ) Notice: Subject to any disclaimer, the term of this patent is extended or adjusted under 35 U.S.C. 154(b) by 0 days.

(21) Appl. No.: 13/345,277

(22) Filed: Jan. 6, 2012

(51) Int. Cl.
*F42B 6/06* (2006.01)

(52) U.S. Cl.
USPC ..... 473/586

(58) Field of Classification Search
USPC ..... 473/578, 585, 586
See application file for complete search history.

(56) References Cited

U.S. PATENT DOCUMENTS 4,867,426 A 9/1989 Mellick
5,039,110 A * 8/1991 Honda ..... 473/586
5,846,147 A * 12/1998 Basik ..... 473/586
6,142,896 A 11/2000 Simo
6,695,727 B1 2/2004 Kuhn
8,105,189 B1 * 1/2012 Huang ..... 473/586
2005/0159256 A1 7/2005 Simo

* cited by examiner

*Primary Examiner* — John Ricci
(74) *Attorney, Agent, or Firm* — Brian S. Steinberger; Law Offices of Brian S. Steinberger, P.A.

(57) ABSTRACT

Arrow vanes, devices and methods for improving arrow vane airfoils for compound arrows, crossbow arrows and traditional arrows, which improves flight characteristics over traditionally manufactured, configured and/or applied vanes. Compound bends in the base of the vanes can be done by clamping the vanes in a channel having a generally straight portion and a generally bent portion. The bent portion can have a helical right bend or a helical left bend. A fletching jig can be used to glue the compound bent bases of the vanes to sides of an arrow shaft.

17 Claims, 5 Drawing Sheets

TOP VIEW

ISO VIEW

TOP VIEW

SIDE VIEW

NOCK END VIEW

TIP END VIEW

PROFILE OF CLAMP

VANE GROOVE IN CLAMP

ARROW VANE AIRFOIL

FIELD OF INVENTION

This invention relates to archery arrow vanes, and more particularly to arrow vanes, devices and methods for improving arrow vane airfoils for compound arrows, crossbow arrows and traditional arrows, which improves flight characteristics over traditionally manufactured, configured and/or applied vanes.

BACKGROUND AND PRIOR ART

In order to increase rotation of an arrow in flight, vanes have been attached at helical and/or offset orientations to the arrow shaft. However, due to decreased spacing between the vanes, the helical and offset mounted vanes often interfere with the arrow rest of the bow when the arrow is being shot. This interference is known to cause the arrow to change direction after it is shot and can result in the arrow wobbling during flight, which can result in poor target accuracy and shorter flight distance. See for example, U.S. Pat. No. 4,867,426 to Mellick.

Additionally, helically oriented and off-set oriented vanes present a similar problem when shot down a rigid, planar-crossbow arrow track. The rigid, planar track, will not physically allow the passage of these helically oriented and off-set oriented vanes as the vanes interfere with the planar nature of the crossbow arrow track which is a machined or molded track in which the arrow vane is slipped and the arrow can miss its' target.

Various types of arrow vanes have been proposed over the years to deal with these problems. See for example, U.S. Pat. No. 6,142,896 to Simo and U.S. Patent Application Publication 2005/0159256 to Simo et al.

However, these vanes are generally flat planar vanes with little or no curved aerodynamic surface. These previous vanes are planar and have molded "kickers" that are supposed to serve as an airfoil and induce longitudinal spin-stabilization. The "airfoil" portion of these flat, planar vanes is in the aft end. The "kicker" used in these references is a very low-efficiency protuberance. It relies on aerodynamic drag to induce spin-stabilization, slowing the arrow's speeds.

However, these products have not been commercially successful due to the planar surface. During flight, these planar vanes with molded kickers and "airfoil" shapes flex and then flutter uncontrollably during flight due to the great amount of turbulent airflow over their surfaces. These modified vanes, which increase aerodynamic drag exponentially, slow the arrow and result in less than desirable results.

The subject inventor patented U.S. Pat. No. 6,695,727, which included an arrow vane device that requires a pre-assembled vane arrangement on an arrow shaft to be screwably attached to shaft. The problem here is that most arrows do not allow for a separate attachment shaft with vane. So this prior art would not be useful to be used with most existing arrows.

This patent described the use of molded vanes that had a strictly planar foot section. These airfoil equipped vanes were manufactured by a molding process. Unlike the present invention that utilizes any commercially available arrow vane (planar) to form a three-dimensional airfoil by physically wrapping the foot section around the arrow shaft causing the vane to mold itself into a three-dimensional airfoil.

Thus, there exists the need for solutions to the problems addressed in the prior art.

SUMMARY OF THE INVENTION

A primary objective of the present invention is to provide arrow vanes, devices and methods for improving arrow vane airfoils for compound arrows, crossbow arrows and traditional arrows, which improves flight characteristics over traditionally manufactured, configured and/or applied vanes.

A secondary objective of the present invention is to provide arrow vanes, devices and methods for improving arrow vane airfoils for compound arrows, crossbow arrows and traditional arrows, which allows the user to apply any commercially available flat, planar vane in a manner which converts the flat planar vanes into a three-dimensional airfoil type vane that provides laminar airflow across the vane surfaces, resulting in a spin-stabilized flight of said projectile (arrow).

A third objective of the present invention is to provide arrow vanes, devices and methods for improving arrow vane airfoils for compound arrows, crossbow arrows and traditional arrows, with a three-dimensional airfoil shape that provides aerodynamic lift to said arrow (i.e., projectile) resulting increased trajectories (i.e., the arrow remain aloft longer than traditionally arranged vanes which result in aerodynamic drag across their vane surfaces).

A fourth objective of the present invention is to provide arrow vanes, devices and methods for improving arrow vane airfoils for compound arrows, crossbow arrows and traditional arrows, having a compound bending of the planar vane, and resulting airfoil, which provides structural rigidity to the said vane, eliminating fluttering during flight, and resulting in increased arrow speeds and increased accuracy.

A fifth objective of the present invention is to provide arrow vanes, devices and methods for improving arrow vane airfoils for compound arrows, crossbow arrows and traditional arrows, having a design with a very diminutive profile, with regard to the longitudinal axis of the arrow shaft, which allows the said vane to be shot down a crossbow track without interference.

A sixth objective of the present invention is to provide arrow vanes, devices and methods for improving arrow vane airfoils for compound arrows, crossbow arrows and traditional arrows, having the only arrow vane configuration which allows for spin-stabilization of crossbow arrows (sometimes referred to as "crossbow bolts").

The present invention utilizes a three-dimensional airfoil that is formed when the planar vanes is wrapped around the arrow shaft, causing the planar vane to form an airfoil along its length (or a portion of said length). The amount (degree) of airfoil is determined by the amount of vane that is "wrapped" around the arrow shaft. The current invention utilizes laminar air flow across the vane and airfoil surface to induce spin stabilization. Faster arrows speeds are achieved due to the lack of aerodynamic drag.

An arrow vane configuration, can include an arrow shaft having a tip end and a nock end, a plurality of compound bent aerodynamic vanes, each having a base, and mounts for mounting the bases of the compound bent aerodynamic vanes on the shaft, wherein the mounts form three dimensional airfoil vanes from the compound bent aerodynamic vanes, in order to provide for spin stabilized flights of an arrow having the three dimensional airfoil vanes.

The bases of the compound bent aerodynamic vanes can include both a generally straight portion and a bent portion. The bent portion can have a right helical pattern. The bent portion can have a left helical pattern.

The generally straight portion can be up to approximately 1 to approximately 3 degrees off center, and the bent portion can be approximately 1 to approximately 20 degrees off center, so that the bent portion is more off-center than the generally straight portion.

The mounts can include a fletching clamp having a channel for supporting and clamping a vane therein, the channel having a generally straight portion and a generally bent portion. The bent portion can have a right helical pattern. The bent portion can have a left helical pattern. The generally straight portion can be up to approximately 1 to approximately 3 degrees off center, and the bent portion can be approximately 1 to approximately 20 degrees off center, so that the bent portion is more off-center than the generally straight portion.

The arrow can be a crossbow arrow. The arrow can be a compound arrow. The arrow can be a traditional arrow made of wood or similar materials known to those familiar with the prior art.

A method of providing spin stabilization to an arrow, can include the steps of providing an arrow with an arrow shaft having a tip end and a nock end, providing a plurality of planar vanes, compound bending each of the planar vanes to the sides of the arrow shaft adjacent to the nock end to provide rigidity to the vanes, and increasing arrow speeds and increased accuracy and reducing fluttering when the arrow is shot from a bow.

The compound bending step can includes the step of mounting a front base portion of the planar vanes to the arrow shaft in a generally straight orientation, and mounting a rear base portion of the of the planar vanes to the arrow shaft in a bent orientation. The bent portion can include a right helical orientation. The bent portion can include a left helical orientation.

The compound bending step can include the steps of preforming a front base portion of the planar vanes in a generally straight orientation, and preforming a rear base portion of the of the planar vanes in a bent orientation. The preforming steps can include the step of compressing base portions of the vanes in a clamp having a generally straight channel and a generally bent channel.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
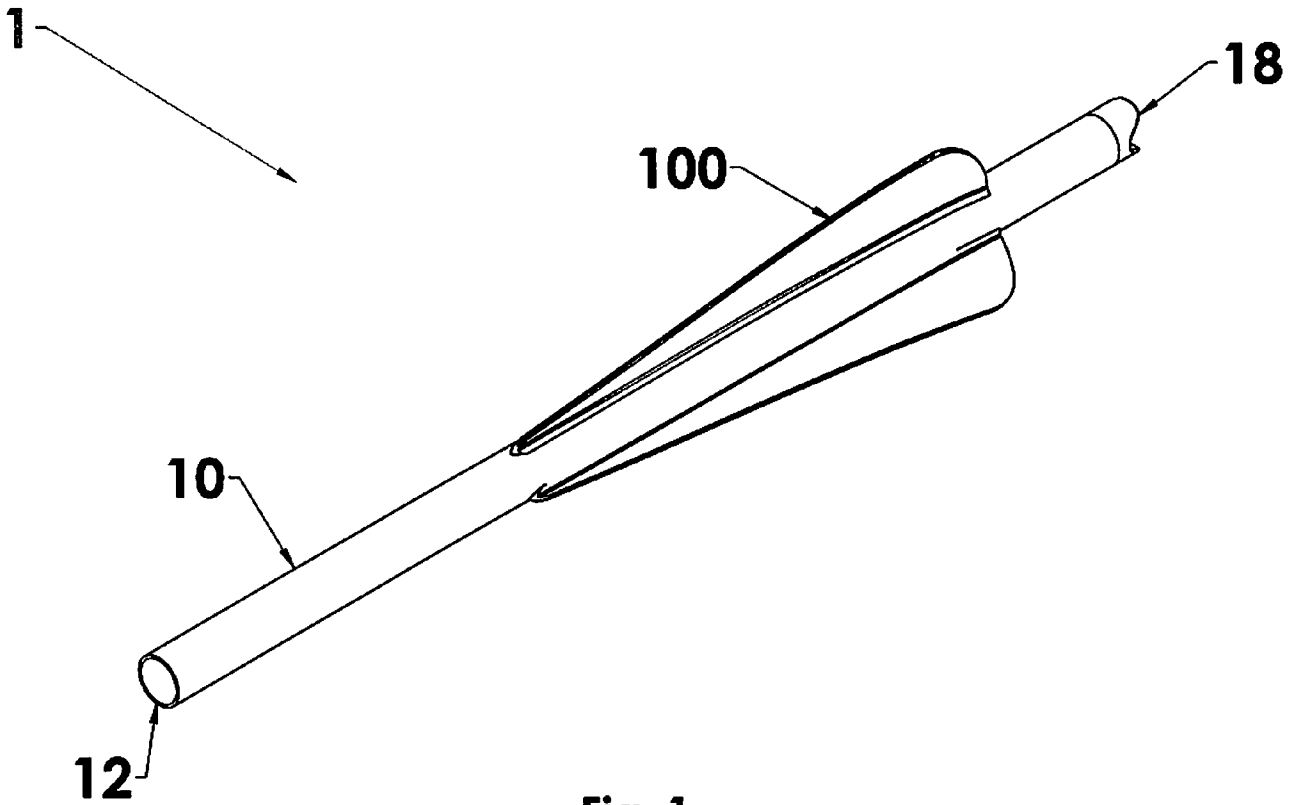
FIG. 1 is a perspective view of the novel vane airfoil on an arrow.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The components labeled in the figures are listed below.

1. Arrow with novel aerodynamic airfoil vanes.
10. shaft of arrow
12. tip end of arrow
18. nock end of arrow
100. aerodynamic airfoil vane(s)
110. leading edge of vane(s)
140. trailing edge of vane(s)
200. bend creating fletching clamp
210. clamp handle
220. clamp handle
230. front side housing
240. rear side housing
250. groove for vane
252. straight channel in groove
255. bent channel portion in groove
300. base of bent vane on shaft
310. generally straight portion
320. bent portion The current invention allows the user to apply any commercially available flat, planar vane in a manner which converts the flat planar vanes into a three-dimensional airfoil type vane. By applying the vane in a prescribed manner in the current invention, the flat, planar vanes, are now converted to a three-dimensional airfoil, which implies laminar airflow across the vane surfaces, resulting in a spin-stabilized flight of said projectile (arrow). This three-dimensional airfoil shape provides aerodynamic lift to said arrow (i.e., projectile) resulting in increased trajectories (i.e., the arrow remain aloft longer than traditionally arranged vanes which result in aerodynamic drag across their vane surfaces).

The current invention is novel in that allows a novel application of a planar vane onto a round arrow shaft, causing said planar vane to become three-dimensional.

The current invention, with its compound bending of the planar vane, and resulting airfoil, provides rigidity to the said vane, limiting fluttering dramatically during flight. Resulting in increased arrow speeds and increased accuracy.

The current design, additionally, with its very diminutive profile, with regard to the longitudinal axis of the arrow shaft, allows the said vane to be shot down a crossbow track without interference.

The subject invention, is the only arrow vane configuration which allows for spin-stabilization of crossbow arrows (sometimes referred to as "crossbow bolts").

Figure 2:
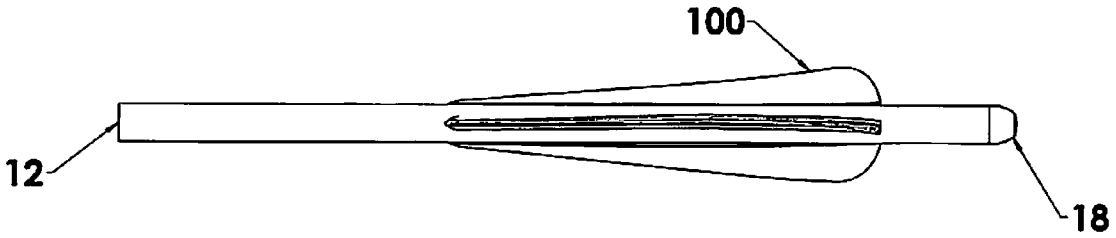
FIG. 2 is a top view of the arrow with novel vane airfoil of FIG. 1.
Figure 3:
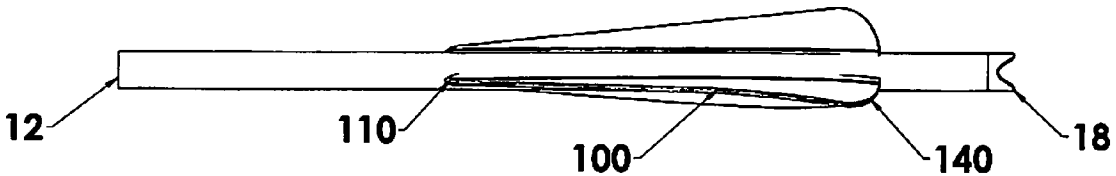
FIG. 3 is a side view of the arrow with novel vane airfoil of FIG. 1.
Figure 4:
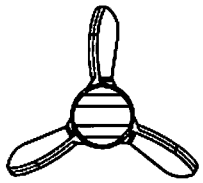
FIG. 4 is a nock end view of the arrow with novel vane airfoil of FIG. 1.
Figure 5:
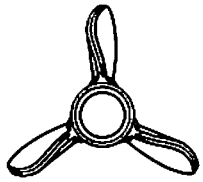
FIG. 5 is a tip end view of the arrow with novel vane airfoil of FIG. 1.

FIG. 1 is a perspective view of the novel vane airfoil 100 on an arrow 1. FIG. 2 is a top view of the arrow 1 with novel bent vane airfoil 100 of FIG. 1. FIG. 3 is a side view of the arrow 1 with novel vane airfoil 100 of FIG. 1. FIG. 4 is a nock end 18 view of the arrow 1 with novel vane airfoil 100 of FIG. 1. FIG. 5 is a tip end 12 view of the arrow 1 with novel vane airfoil 100 of FIG. 1.

Referring to FIGS. 1-5, a plurality of novel bent airfoil vanes 100 can be mounted about a shaft 10 of an arrow 1. Each of the aerodynamic airfoil vane(s) 100 can include a generally straight leading edge 110 attached to the shaft 10 with a trailing edge bent portion 140 attached adjacent to the nock end 18 of the shaft 10.

Figure 6:
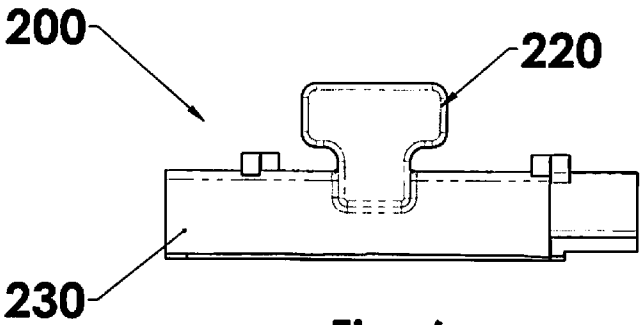
FIG. 6 is a side view of a novel fletching jig that can be used to both create the bend in the vane and to attach the bent vane to the arrow shaft.
Figure 7:
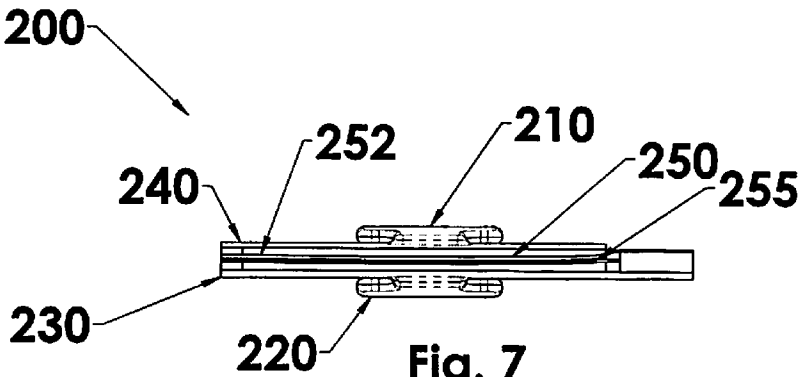
FIG. 7 is a top view of the fletching jig of FIG. 6 showing the bent vane groove in the clamp.
Figure 8:
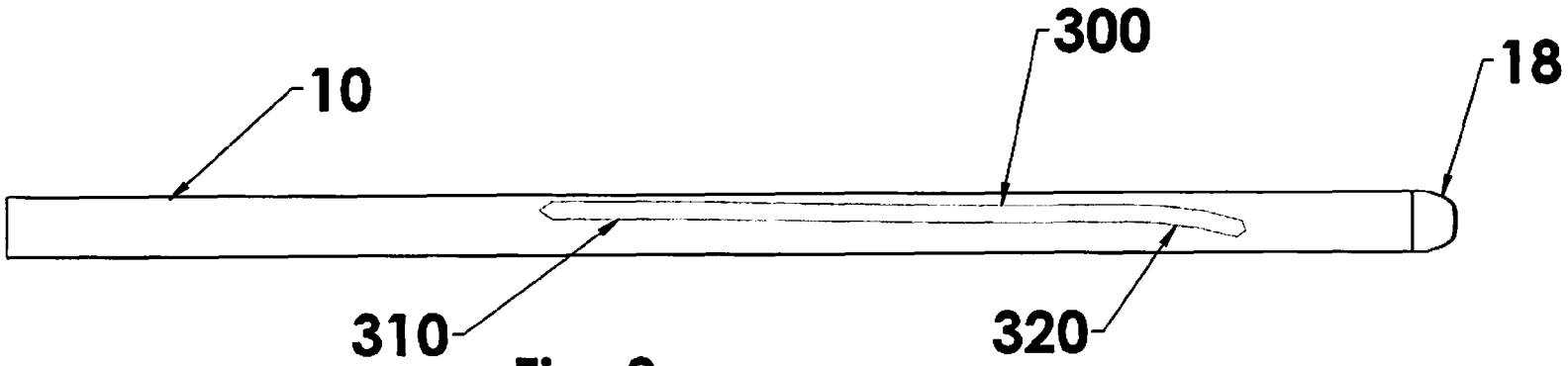
FIG. 8 is a side view of an arrow shaft showing the contact portion of the bent vane.

FIG. 6 is a side view of a novel fletching jig 200 that can be used to both create the bend in the vane and to attach the bent vane to the arrow shaft. FIG. 7 is a top view of the fletching jig 200 of FIG. 6 showing the bent vane groove 250 in the clamp housing 230, 240. FIG. 8 is a side view of an arrow shaft 10 showing the base 300 of the bent vane.

To convert a normal flat, planar vanes to an airfoil, the fletching jig 200 (the mechanical apparatus that applies the vane, or "mounts" the vane to the arrow shaft), actually bends that planar vanes "around" the circumference of the arrow shaft.

Referring to FIGS. 6-8, the invention can use a fletching jig 200 that can be modified version of a conventional fletching jig, such as the one described and shown in U.S. Pat. No. 4,867,426 to Mellick, which is incorporated by reference. The prior art as shown and described by at least the Mellick patent shows and describes how a vane can be attached to the shaft of an arrow by supporting the vane in a fixed orientation with a fletch clamp with the base of the vane exposed. An adhesive, such as glue, can then be applied against the bottom of the base of the vane. Next, a fletching jig can hold the base of the clamped vane having the adhesive thereon in an abutting position against a surface of the shaft. Additional glue type adhesive can be applied about the edges where the base of the vane contacts the shaft. After the glue dries and the vane becomes fixed to the shaft, the jig and clamp are removed. Additional vanes can be attached in a similar manner.

In the subject invention, the plastic vane is pliable enough to be bent into different twisted orientations. For example, as the vane is bent around the round arrow shaft, it forms a three-dimensional airfoil.

As shown in FIGS. 6-7, a planar vane can be inserted into a pre-curve shaped groove 250 in the bend creating fletching clamp 200. The clamp handles 210, 220 can be separated apart from one another so that the planar vane can be inserted into the groove. As the clamp handles 210,220 are closed the front side 230 and rear side 240 of the housings compress the vane so that a portion of the vane compressed by the straight groove channel portion 252 remains generally straight and the bent channel portion 255 in the groove 250 forms a bent twist in the vane. Next, the novel jig clamp 200 can be used for attaching the vanes 100 to the arrow shaft 10. The vane 100 is then glued into place to hold the three-dimensional shape. When dried, the adhesive, is able to permanently hold the aerodynamically bent vane 100 in a bent configuration to the shaft 10.

As shown in the Mellick '426 patent, only a continuous helical vane orientation as shown in FIGS. 3, 5 or a straight edge vane orientation as shown in FIG. 4 can be done. The subject invention allows for a compound bending of the vane, where as shown in FIG. 8, the base of the vane 300 can have a generally straight portion 310 along at least half of the base of the vane and a bent portion 320 along the rest of the base of the vane. The lower portion 320 of the base of the vane can be curved at a different twist than the rest of the vane base. In some applications, the upper base portion 310 can be approximately 2 degrees off-center, while the lower base portion 320 of more off center (such as approximately 6 degrees or more off-center). The subject invention can allow for a novel combination of a generally straight upper base and a lower base of the vane having a helical orientation. The novel compound bent vane can have a customized bend as defined by the groove formed from the clamping mechanism, such as but not limited to the clamping apparatus 200 in FIGS. 6-7.

The novel fletching jig 200 "bends" or "contours" the arrow vane "around" the arrow shaft 10. The fletching jig is designed to apply the arrow vanes "around" the circumference of the arrow shaft. As the vane is bent, it forms a three dimensional airfoil. No one specific geometry ("bend") works for every application. Any number of airfoil shapes can work. The difference is the amount of aerodynamic lift produced by the different shapes.

Although the preferred embodiments reference vanes for various types of arrows, the invention can be applicable with other types of projectiles that are to be launched, such as but not limited to darts, missiles, crossbows, blow guns, spear guns, toy weapons, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An arrow vane configuration, comprising:

an arrow shaft having a tip end and a nock end;

a plurality of compound bent aerodynamic vanes, each having a base; and mounts for mounting the bases of the compound bent aerodynamic vanes on the shaft, wherein the mounts form three dimensional airfoil vanes from the compound bent aerodynamic vanes, in order to provide for spin stabilized flights of an arrow having the three dimensional airfoil vanes.

2. The arrow vane configuration of claim 1, wherein the bases of the compound bent aerodynamic vanes include both a generally straight portion and a bent portion.

3. The arrow vane configuration of claim 2, wherein the bent portion includes:

a right helical pattern.

4. The arrow vane configuration of claim 2, wherein the bent portion includes:

a left helical pattern.

5. The arrow vane configuration of claim 2, wherein the bent portion is more off-center than the generally straight portion, and wherein the generally straight portion is up to approximately 1 to approximately 3 degrees off center and the bent portion is approximately 1 to approximately 20 degrees off center.

6. The arrow vane configuration of claim 1, wherein the mounts include:

a fletching clamp having a channel for supporting and clamping a vane therein, the channel having a generally straight portion and a generally bent portion.

7. The arrow vane configuration of claim 6, wherein the bent portion includes:

a right helical pattern.

8. The arrow vane configuration of claim 6, wherein the bent portion includes:

a left helical pattern.

9. The arrow vane configuration of claim 6, wherein the bent portion is more off-center than the generally straight portion, and wherein the generally straight portion is up to approximately 1 to approximately 3 degrees off center and the bent portion is approximately 1 to approximately 20 degrees off center.

10. The arrow vane configuration of claim 1, wherein the arrow is a crossbow arrow.

11. The arrow vane configuration of claim 1, wherein the arrow is a compound arrow.

12. A method of providing spin stabilization to an arrow, comprising the steps of:

providing an arrow with an arrow shaft having a tip end and a nock end;

providing a plurality of planar vanes;

compound bending each of the planar vanes to the sides of the arrow shaft adjacent to the nock end to provide rigidity to the vanes, wherein the compound bending step includes the steps of:

mounting a front base portion of the planar vanes to the arrow shaft in a generally straight orientation; and mounting a rear base portion of the of the planar vanes to the arrow shaft in a bent orientation that is more off-center than the front base portion; and increasing arrow speeds and increased accuracy and reducing fluttering when the arrow is shot from a bow.

13. The method of claim 12, wherein the bent portion includes a right helical orientation.

14. The method of claim 12, wherein the bent portion includes a left helical orientation.

15. A method of providing spin stabilization to an arrow, comprising the steps of:

providing an arrow with an arrow shaft having a tip end and a nock end;

providing a plurality of planar vanes;

compound bending each of the planar vanes to the sides of the arrow shaft adjacent to the nock end to provide rigidity to the vanes, wherein the compound bending step includes the steps of:

preforming a front base portion of the planar vanes in a generally straight orientation; and preforming a rear base portion of the of the planar vanes in a bent orientation, that is more off-center than the front base portion; and increasing arrow speeds and increased accuracy and reducing fluttering when the arrow is shot from a bow.

16. The method of claim 15, wherein the preforming steps include the steps of:

compressing base portions of the vanes in a clamp having a generally straight channel and a generally bent channel.

17. A method of providing spin stabilization to an arrow, comprising the steps of:

providing an arrow with an round arrow shaft having a tip end and a nock end;

providing a plurality of planar plastic vanes;

applying the planar plastic vanes onto the round arrow shaft; and forming the planar vanes into three-dimensional airfoils that spin-stabilizes an arrow shaft in flight, wherein the forming step includes the steps of:

providing a front base portion and a rear base portion for the vanes;

bending the rear base portion to be more off-center than the front base portion, so that the front base portion is up to approximately 1 to approximately 3 degrees off center and the rear base portion is approximately 1 to approximately 20 degrees off center.

* * * * *